US006594923B1

(12) United States Patent
Kost et al.

(10) Patent No.: US 6,594,923 B1
(45) Date of Patent: Jul. 22, 2003

(54) SNOWPLOW MOUNT

(75) Inventors: James A. Kost, Willoughby, OH (US); Robert L. Potak, Strongsville, OH (US)

(73) Assignee: The Louis Berkman Company, Steubenville, OH (US)

( * ) Notice: Subject to any disclaimer, the term of this patent is extended or adjusted under 35 U.S.C. 154(b) by 0 days.

(21) Appl. No.: 09/960,910

(22) Filed: Sep. 24, 2001

Related U.S. Application Data

(63) Continuation-in-part of application No. 09/465,887, filed on Dec. 17, 1999, now Pat. No. 6,276,075, and a continuation-in-part of application No. 09/449,945, filed on Nov. 29, 1999, now Pat. No. 6,354,024.

(60) Provisional application No. 60/271,800, filed on Feb. 27, 2001.

(51) Int. Cl.[7] ..... E01H 5/04

(52) U.S. Cl. ..... 37/231

(58) Field of Search ..... 37/231–236, 266, 37/270, 271; 172/816–827, 762, 763, 792, 779

(56) References Cited

U.S. PATENT DOCUMENTS

| | | | |
|---|---|---|---|
| 2,667,708 | A | 2/1954 | Gjesdahl |
| 3,214,138 | A | 10/1965 | Jocher et al. |
| 3,252,716 | A | 5/1966 | Gaterman |
| 3,353,287 | A | 11/1967 | King |
| 3,365,456 | A | 1/1968 | Petrzilka et al. |
| 3,400,475 | A | 9/1968 | Peitl |
| 3,410,008 | A | 11/1968 | Standfuss |
| 3,432,946 | A | 3/1969 | Peitl |
| 3,432,947 | A | 3/1969 | Peitl |
| 3,456,369 | A | 7/1969 | Leponsky |
| 3,650,054 | A | 3/1972 | Hanson |
| 3,706,144 | A | 12/1972 | Miceli |
| 3,749,180 | A | 7/1973 | Coontz |
| 3,800,882 | A | 4/1974 | Werts et al. |
| 3,815,687 | A | 6/1974 | Federspiel |
| 3,828,449 | A | 8/1974 | Miceli |
| 3,987,562 | A | 10/1976 | Deen et al. |
| 4,236,329 | A | 12/1980 | Hetrick |
| 4,238,895 | A | 12/1980 | Hetrick |
| 4,254,564 | A | 3/1981 | Rath |
| 4,279,084 | A | 7/1981 | Low et al. |
| 4,369,590 | A | 1/1983 | Miller |
| 4,528,762 | A | 7/1985 | Sarka et al. |
| 4,790,085 | A | 12/1988 | Rossman |
| 4,803,790 | A | 2/1989 | Ciula |
| 4,821,436 | A | 4/1989 | Slocum |
| 4,845,866 | A | 7/1989 | Ciula |
| 4,848,483 | A | 7/1989 | Heiple |
| 4,924,610 | A | 5/1990 | Sodemann |
| 4,976,054 | A | 12/1990 | Jones |
| 5,036,608 | A | 8/1991 | Ciula |
| 5,075,988 | A | 12/1991 | Ciula |
| 5,088,215 | A | 2/1992 | Ciula |
| 5,353,530 | A | 10/1994 | Pieper |
| 5,447,204 | A | 9/1995 | Asal et al. |
| 5,477,600 | A | 12/1995 | Houle et al. |
| RE35,700 | E | 12/1997 | Watson et al. |
| 5,806,214 | A | 9/1998 | Behrens et al. |
| 5,832,637 | A | 11/1998 | Aguado et al. |
| 5,870,839 | A | 2/1999 | Willmiller |
| 5,894,688 | A | 4/1999 | Struck et al. |

(List continued on next page.)

OTHER PUBLICATIONS

Copy of Application Ser. No. 09/449,945, filed Nov. 29,1999.

*Primary Examiner*—Robert E. Pezzuto
(74) *Attorney, Agent, or Firm*—Fay, Sharpe, Fagan, Minnich & McKee

(57) ABSTRACT

A snowplow blade mount assembly mountable on a vehicle that includes a blade mount assembly which connects a snowplow blade to a vehicle. The blade mount assembly enables the snowplow blade to pivot in several planes.

60 Claims, 9 Drawing Sheets

U.S. PATENT DOCUMENTS

| | | | |
|---|---|---|---|
| 5,899,007 | A | 5/1999 | Niemela et al. |
| 6,035,944 | A | 3/2000 | Neuner et al. |
| 6,050,008 | A | 4/2000 | Doornek et al. |
| 6,073,371 | A | 6/2000 | Goos et al. |
| 6,134,813 | A | 10/2000 | Vickers |
| 6,145,222 | A | 11/2000 | Curtis |
| 6,151,808 | A | 11/2000 | Curtis |
| 6,163,985 | A | 12/2000 | Chinnery et al. |
| 6,170,178 | B1 | 1/2001 | Christy |
| 6,178,669 | B1 | 1/2001 | Quenzi et al. |
| 6,276,075 | B1 | 8/2001 | Kost et al. |

SNOWPLOW MOUNT

The present invention claims priority on U.S. Provisional Application Serial No. 60/271,800 filed Feb. 27, 2001 entitled "Improved Snowplow Mount." The present invention is also a continuation-in-part of U.S. patent application Ser. No. 09/465,887 filed Dec. 17, 1999, now U.S. Pat. No, 6,276,075 entitled "Snowplow Blade Support Apparatus." The present invention is further a continuation-in-part of U.S. patent application Ser. No. 09/449,945 filed Nov. 29, 1999, U.S. Pat. No. 6,354,024 entitled "Snowplow Mount."

This invention relates primarily to snowplows and more particularly to an improvement in snowplows mountable on a motor vehicle for removing snow and other debris from roadways and similar surfaces. In particular, the present invention relates to the art of mounting snowplows to automotive vehicles, and more particularly an apparatus for mounting a snowplow blade on a vehicle-mounted snowplow supporting frame attached to a vehicle equipped with controls for positioning the frame and the snowplow blade. The invention is particularly applicable to a snowplow apparatus and construction, wherein an improved snowplow mount assembly is provided for attaching and detaching the snowplow from the vehicle and will be described with particular reference thereto.

INCORPORATION BY REFERENCE

U.S. Pat. No. 3,353,287; 3,365,456; 3,400,475; 3,432,946; 3,432,947; 3,650,054; 3,706,144; 3,828,449; 4,236,329; 4,279,084; 4,528,762; 4,803,790; 4,845,866; 5,036,608; 5,075,988; 5,088,215; 6,134,813; and 6,276,075; and co-pending U.S. patent application Ser. Nos. 09/449,945 filed Nov. 29, 1999; and 60/271,800 filed Feb. 27, 2001 are also incorporated herein by reference to illustrate various snowplow blade designs and snowplow blade support units known in the art. Accordingly, the invention will be disclosed and described in detail herein in conjunction with a snowplow and various supporting frame hardware typical of those disclosed in the above referenced patents. It will be appreciated, however, that the present invention can be applied to other styles and types of snowplows and supporting frames.

BACKGROUND OF THE INVENTION

It is common for owners of vehicles to equip the vehicle with a snowplow for the purpose of removing snow from a ground surface. These vehicles include cars, jeeps, sport utility vehicles, pick-up trucks and the like. Each type of vehicle has a different frame structure and a different bumper design to accommodate the frame structure. At present, the most commonly used arrangement for attaching a snowplow blade to a vehicle involves pivotally connecting an A-frame which supports the blade to a frame extension below the front of the vehicle. Vertical displacement of the snowplow blade in the A-frame is provided by a lift-mount assembly. The lift-mount assembly serves primarily to raise, lower and support the plow blade, such as by raising the plow blade above the ground during transportation of the snowplow blade as well as during a snowplow operation. The lift-mount assembly typically includes a hydraulic cylinder, lift arm and chain or cable arrangement mounted above the vehicle frame. Typically, the A-frame is aligned with the vehicle frame below the front of the vehicle to provide proper blade alignment.

The A-frame generally includes a frame assembly supporting a plow blade forwardly of the vehicle and having an inner end design to be releasably hitched to the support structure beneath the vehicle. Detachment of the snowplow blade unit from the vehicle enables use of the vehicle for personal and/or work oriented purposes other than snowplowing.

Depending on the type of the frame mount used, the frame mount typically projects out beyond, or coplanar with, the bumper thereby defeating the purpose of the bumper. In addition, the frame mount becomes a potentially dangerous battering ram when extended past the bumper, and is subjected to being damaged in a collision. Such prior art lift assemblies are disclosed in U.S. Pat. Nos. 2,667,708; 3,214,138; 3,410,008; 3,456,369; and 3,987,562. In addition, these prior art mount assemblies include one or more of a number of structural disadvantages, such as a) excessive weight, b) exposure to adverse environmental conditions, c) potential physical damage during non-snowplowing use, d) high cost of manufacture, e) difficulty in mounting to a variety of vehicle frames, and f) undesirable aesthetics when used on a vehicle. More particularly, with regard to such disadvantages, these prior art lift mount assemblies are typically 1) mounted on the existing vehicle bumper or on a special cross member between the vehicle frame members which either replaces or is provided in addition to the bumper, or 2) are mounted on one of the vehicle's frame and bumper components and interconnected with one another. Furthermore, due to the design of these prior art mounting systems, when the snowplow blade is elevated, the lift arm mounting members cause considerable stress at the point of connection between the mounting members and the vehicle as a result of the weight of the corresponding snowplow blade unit. Such forces necessitate structurally heavy mounting members and supports and special structural interconnections therebetween in an effort to minimize damage and/or bending or breakage of the mounting members and/or support components. This results in undue weight to the support unit and increased complexity in the assembly and the repair of the support unit. The lift arm assemblies are also intended to remain on the vehicle when the snowplow unit is removed therefrom. This is undesirable from the stand point of the weight imposed on the front axle of the vehicle and can result in a violation of one or more governmental restrictions with respect to vehicle loading. In addition, one or more of the lift components project a considerable distance forward of the vehicle bumper thus exposing such components to damage or destruction should the vehicle impact against an object. Moreover, these components, when exposed to the elements year round, can begin to deteriorate, therefore requiring more frequent maintenance, repair and replacing, thus increasing the expense of using such an assembly. The permanent fixture of these components to the vehicle also can significantly deteriorate from the aesthetic appearance of the front of the vehicle during non-winter months.

Many efforts have been made to resolve several of these problems with respect to the use of snowplow blades. Assignees' U.S. Pat. No. 4,279,084 improves on a number of draw backs of prior art lift mount assemblies. The lift mount assembly reduces the number of modifications to the front end of the vehicle to accommodate the lift mount assembly. The lift mount assembly replaces projecting parts on the lift mount assembly with somewhat recessed exposed parts which do not bear the full impact of a collision should the vehicle impact against an object during non-snowplow use. However, the foremost part of the bracket portion of the lift mount assembly is located on the same vehicle plane as the foremost part of the bumper. Therefore, both the bumper and the lift mount bear the brunt of any collision. Potential damage to the lift mount assembly remains a likelihood on the collision. The lift mount assembly also must be positioned behind the bumper which can present installation problems. The mount assembly also requires some rigging to establish the top mounting point behind the bumper which can be troublesome for some vehicles.

Assignees' U.S. Pat. No. 5,036,608 improved on many of the remaining drawbacks of existing mount assemblies. The mount assembly is a two piece assembly wherein the housing unit is affixed to the frame of the vehicle beneath and behind the bumper of the vehicle thereby eliminating parts of the housing from being damaged on collision by the vehicle. The lift mount assembly also includes a support unit which releasably attaches to the housing and is designed to support components of the mount assembly to lift and lower the snowplow frame assembly. When the snowplow blade and A-frame are removed from the housing unit, the support unit may also be removed thereby eliminating projecting parts of the lift mount assembly from being exposed to damage. The removal of these components also enhances the authentic appearance of the vehicle during non-winter months and prevents the lift mount assembly components from being exposed to the elements throughout the year.

Although U.S. Pat. No. 5,036,608 is a significant improvement over prior art lift mount assemblies, the improved lift mount assembly does not address several problems with respect to the mounting of the lift assembly and blade mount assembly,to various types of vehicles, the adjustment of the lift assembly to various types of vehicles, and the difficulty in attaching and detaching the lift assembly and/or snowplow blade mount assembly from the vehicle. Assignee's U.S. patent application Ser. No. 09/449,945 filed Nov. 29, 1999 entitled "Snowplow Mount" addresses the problems associated with the mounting of the lift assembly and blade mount assembly to various types of vehicles. The frame mount assembly disclosed in U.S. patent application Ser. No. 09/449,945 advantageously enables quick release and removal of the support assembly from the supporting portion of the frame mount assembly, whereby only the frame mount assembly need remain on the vehicle during non-snowplowing use of the vehicle. Components of the support assembly and components attached thereto can be stored and thus protected from adverse environmental conditions and potential damage by impact of the vehicle with another object during non-snowplowing use thereof.

In many of the snowplow systems shown in the above patents, the snowplow blade is supported on a vehicle using a pivotal mounting frame allowing an operator to pivot the blade about a vertical axis and thereby to selectively direct the plowed snow to either side of the vehicle path. Such mounting frames are generally mounted on a vehicle for pivoting about a horizontal axis near the front of the vehicle whereby the snowplow blade may also be selectively raised and lowered using hydraulic controls mounted on the vehicle. The snowplow blade itself is typically attached to the mounting frame for limited rotation about a horizontal mounting axis near the snowplow blade and is further equipped with springs connected between the snowplow blade and the mounting frame to dampen this rotational movement and to bias the snowplow blade to an upright position. In addition, the snowplow blade may optionally be offset from the ground using skids or casters mounted to the mounting frame. This is particularly desirable for heavy highway plows to minimize damage to the road surface. U.S. Pat. Nos. 3,706,144 and 3,828,449 illustrate an arcuate snowplow blade support member wherein the snowplow blade is mounted on a U-shaped support member using trunnions. The support member provides manual adjustment of the blade angle about a center pin and lock. Springs are connected between the blade and the support member to hold the blade upright and to dampen the pivoting of the blade about the trunnion axis as the blade contacts obstacles. Hydraulic control of the snowplow blade angle is provided. In U.S. Pat. No. 3,353,287, the snowplow blade support system includes a C-shaped channel member pivotally attached to the blade with pins, forming a sector arrangement with an arcuate plate member. This configuration further includes two horizontal V-shaped brace members between the arcuate member and the C-shaped channel member. Manual adjustment of the blade angle is disclosed, wherein the blade pivots around an axis through the C-shaped channel member and is locked in a desired position. In U.S. Pat. No. 4,803,790, a C-shaped support member is illustrated as having no arcuate supporting structure. In applications employing lightweight snowplow blades, a single C-shaped support member has proven adequate. However, larger and/or more massive snowplow blades require more supporting strength, particularly for highway plowing applications where the vehicle speed exceeds that of typical parking lot or driveway operations. Adding further supporting braces and members, as shown in U.S. Pat. Nos. 3,706,144 and 3,828,449, adds further cost, complexity and weight to the system. Other methods of strengthening the C-shaped support member of Ciula include selection of different materials and increasing the thickness. These methods, however, further add to the cost and weight of the blade support apparatus, and are therefore undesirable. Optional support for vehicle snowplow blades is provided by skids as shown in U.S. Pat. Nos. 3,400,475; 3,432,946; 3,432,947, or by casters as shown in U.S. Pat. No. 4,528,762. In these systems, the skid or caster may be vertically adjusted by rotating a threaded shaft, and fixed by tightening a nut on the shaft. Alternatively, the vertical spacing between the skids or casters and the plow blade may be adjusted using a vertical skid shaft inserted within a vertical supporting plate, wherein horizontal holes are provided in the shaft and the plate for receiving a pin. The use of a threaded shaft is an expensive method, as threaded surfaces must be provided both in the shaft as well as in the vertical structure to which the shaft is mounted. Horizontal holes and pins in combination provide relatively inexpensive vertical adjustment for skids or casters. However, such a pin must bear the vertical load of the snowplow mass, which can be very large for highway plows and the like. The pin must therefore be sized to accept the shear forces caused by the snowplow load. It is therefore desirable to provide a system for vertical adjustment of snowplow blade supporting skids, rollers, or casters which provides adequate vertical load handling capabilities with little or no increase in cost or complexity over the prior systems. Assignee's U.S. patent application Ser. No. 09/465,887 filed Dec. 17, 1999 entitled "Snowplow Blade Support Apparatus" overcomes the problems associated with vertical adjustment of snowplow blade supporting skids, rollers or caster systems. U.S. patent application Ser. No. 09/465,887 discloses a snowplow blade mounting apparatus which includes an I-beam support member adapted to support a typical highway or smaller snowplow for damped limited pivotal movement about a horizontal axis. The single support I-beam member has higher load carrying capabilities and lower torsional flexure than a similarly sized C-shaped channel member of the same weight and thickness. The flanges of the I-beam overhang both sides of the beam web, thus providing additional weld points on the inwardly facing flange surfaces of both sides. As a result, clevis plates may be welded to both the I-beam web and the flange of both sides of the I-beam to provide superior weld joint strength over a weld to the web alone.

Although the snowplow blade mounts disclosed in U.S. patent application Ser. No. 09/449,945 filed Nov. 29, 1999 entitled "Snowplow Mount" and U.S. patent application Ser. No. 09/465,887 filed Dec. 17, 1999 entitled "Snowplow Blade Support Apparatus" address many of the deficiencies of prior snowplow mount designs, there remains a need for a snowplow blade mount that allow the snowplow blade to better follow the contour of the road during operation.

SUMMARY OF THE INVENTION

The present invention contemplates a new and improved frame mount assembly for attaching a snowplow blade unit to a vehicle which overcomes all of the above referred problems and enables a lift mount assembly and/or a blade mount assembly to be quickly released from the vehicle and which enables the snowplow blade to better follow the contour of the road during operation. In this respect, the frame mount assembly, according to the present invention, is structurally simple and light in weight, thus enabling a savings in cost while facilitating the installation procedure and reducing the weight imposed on the front axle of the vehicle during snowplowing and non-snowplowing use. The frame mount assembly is structurally independent of the vehicle bumper and is mountable on a vehicle without replacing the original or existing bumper. The frame mount assembly advantageously enables quick release and removal of the support assembly from the supporting portion of the frame mount assembly, whereby only the frame mount assembly need remain on the vehicle during non-snowplowing use of the vehicle. Accordingly, components of the support assembly and components attached thereto can be stored and thus protected from adverse environmental conditions and potential damage by impact of the vehicle with another object during non-snowplowing use thereof. The frame mount assembly is constructed in association with the vehicle so as to advantageously minimize both the visibility of the frame mount assembly and the projection of the parts of the frame mount assembly thereof forwardly of the vehicle when the support assembly is removed, thus promoting the aesthetic appearance of the front of the vehicle. The mounting of the frame mount assembly independent of the vehicle's bumper allows forces and stresses imposed on the frame mount assembly when the snowplow blade is elevated to be transmitted through the frame mount assembly to the vehicle frame, thus avoiding any distortion of the bumper member and/or any disfiguring thereof by attachment of the component parts of the assembly thereto.

In accordance with another aspect of the present invention, a snowplow mount assembly includes four principal components, namely a frame mount assembly, a support assembly, a lift assembly, and a blade mount assembly. The frame mount assembly is affixed to the frame of the vehicle and has at least one attachment point situated beneath and behind the bumper of the vehicle. The support assembly is designed to be connected to the at least one attachment point on the frame mount assembly. The support assembly is also designed to be connected to the lift assembly unit and/or the blade mount assembly. The support assembly thereby integrates the lift assembly and/or blade assembly with the frame mount assembly. The support assembly is mounted to the frame mount assembly in a manner to allow the support assembly to be releasably attached to the frame mount assembly for easy removal from the vehicle. In one embodiment, the removal of the support assembly from the frame mount assembly results in no permanent structures of the snowplow mount protruding beyond the vehicle bumper.

In accordance with still another aspect of the present invention, the lift assembly is designed to be detachable from, or permanently affixed to, the support assembly. In one embodiment, the lift assembly includes a lift arm that is connected or interconnected to the blade mount assembly for lifting and lowering the blade mount assembly. In another embodiment, the lift assembly is permanently affixed to the support assembly.

In accordance with yet another aspect of the present invention, the blade mount assembly is designed to be detachable from, or permanently affixed to, the support assembly. The blade mount assembly is also designed to connect to a snowplow blade. In one embodiment, the blade mount assembly includes an A-frame design to support a snowplow blade. In another embodiment, the snowplow blade includes a frame that has a pivotal mounting adapted for connection with the blade mount assembly, and allowing controlled pivotal movement of the blade with respect to the blade mount assembly about a vertical axis and/or horizontal axis. In still another embodiment, the blade mount assembly includes a control connector for attachment of a hydraulic ram or other controls, allowing a vehicle operator to adjust the snowplow blade angle from inside the vehicle. In yet another embodiment, the blade mount assembly includes a bracket adapted for connection to a spring, whereby the spring may be connected between the blade mount assembly and the blade. In a further embodiment, there is provided runners mounted on the blade mount member and/or blade which are vertically adjustable with respect to the blade mount assembly and/or blade. In still a further embodiment, the blade mount assembly includes an adjustable mount arrangement that mounts to the blade, which mount arrangement enables the blade to rotate in multiple planes. In one aspect of this embodiment, the mount arrangement enables the blade to rotate a limited distance relative to the blade mount assembly. This limited rotation allows the blade to make small adjustments in orientation relative to an uneven ground surface. As a result, the blade is allowed to rotate in an additional plane to enable the base of the blade to follow the uneven contours of a road surface. In still another embodiment, the lift assembly includes a lift chain mount that allows the chain to slightly adjust to accommodate the limited rotation of the snowplow blade as the snowplow blade makes small adjustments in orientation relative to an uneven ground surface. In still another embodiment, the blade mount assembly and/or blade include one or more grease or lubrication fittings to improve the movement of the blade relative to the support member. In one aspect of this embodiment, one or more grease or lubrication fittings are at least partially isolated from the environment to minimize dirt and other debris from adversely affecting the grease or lubrication fitting.

In accordance with still another aspect of the present invention, the frame mount assembly is designed to include a connection section that facilitates in the attachment of the support assembly to the frame mount assembly. The connection section can also function as a structural support for the other components of the frame mount assembly and to help rigidify and strengthen such components. The connection section facilitates in the dismounting of the support assembly from the frame mount assembly. In one embodiment, the frame mount assembly includes one or more regions that at least partially assist in guiding at least a portion of the support assembly into proper orientation with the frame mount assembly so that the support assembly can be mounted to the frame mount assembly. In another specific embodiment, the frame mount assembly includes a landing designed to receive a portion of the support assembly. In this specific embodiment, the landing is designed to have a shape such that a portion of the support assembly inserts into the landing to thereby insure the proper positioning and the proper attachment of the support assembly to the frame mount assembly. In another specific embodiment, the frame mount assembly includes one or more sloped surfaces that guide a portion of the support assembly to a location in the frame mount assembly where the support assembly is mounted to the frame mount assembly.

In accordance with still yet another aspect of the present invention, there is provided a support assembly which includes an end leg member designed to mount with the frame mount assembly. In one embodiment, the end leg portion is designed to have a dimension so as to fit into a specific region of the frame mount assembly. In another embodiment, the support assembly includes a mid-section. The mid section of the support assembly is designed such that a portion of the outer surface of the mid-section forms a complimentary surface with the frame mount assembly when the support assembly is connected to the frame mount assembly. In one embodiment, the end leg member and mid-section of the support assembly are rigidly connected together. In one aspect of this embodiment, the end leg member and the mid-section are formed from a common piece of material. In one specific embodiment, the mid-section of the support assembly includes an opening to receive a connector to secure the support assembly to the frame mount assembly. In this specific embodiment, the frame mount assembly includes an opening which forms a complimentary opening with the opening in the mid-section of the support assembly for the connector to be inserted there through when the support assembly is properly positioned in the frame mount assembly. In another specific embodiment, the support assembly is secured to the frame mount assembly in at least two locations, one at the leg portion and the other at the mid-section of the support assembly. In still another embodiment, the support assembly includes one or more connectors to enable the support assembly to be easily removed and/or attached to the frame mount assembly. In one embodiment, the connector is a pin assembly, bolt assembly, latch assembly, and/or clamp assembly that secures the support assembly to the frame mount assembly. In one specific embodiment, the connector is a pin assembly and/or bolt assembly that is fitted into a hole in the frame mount assembly and through a hole in the support assembly which is aligned with the hole in the frame mount assembly when the support assembly is properly positioned in the frame mount assembly. In another specific embodiment, the connector is a pin assembly and/or bolt assembly that includes a locking and/or position mechanism to lock and/or secure the pin assembly and/or bolt assembly in a certain position during the mounting and/or dismounting of the support assembly to the frame mount assembly. In still another specific embodiment, the connector is a pin assembly and/or bolt assembly that includes a biasing mechanism to bias the pin and/or bolt in a certain position. Preferably, the biasing mechanism biases the pin and/or bolt in an attachment position to assist in maintaining that the support system remains mounted to the frame mount assembly after the support system has been mounted to the frame mount assembly. In one arrangement, the biasing mechanism includes a spring. In a further embodiment, the support assembly includes a blade mount connector designed to connect the blade mount assembly to the support assembly. In one embodiment, the blade mount assembly includes an opening which forms a complimentary opening with an opening in the support assembly for a connector to be inserted there through when the blade mount assembly is properly positioned with respect to the support assembly. In this specific embodiment, the blade mount assembly can pivot about the connector or be rigidly secured to the support assembly. In still another embodiment, the blade mount assembly can be attached and/or detached from the support assembly. In one specific embodiment, the blade mount assembly is connected to the support assembly at a different location on the support assembly from the location the support system is connected to the frame mount assembly. In another embodiment, the support assembly includes a second end leg member designed to connect the lift mount assembly to the support assembly. In one embodiment, the second end leg member is rigidly connected to a portion of the lift mount assembly. The rigid connection can be formed by a weld, bolt, pin, clamp, or the like. In another embodiment, a portion of the lift assembly is formed from a common portion of the support assembly. In still another embodiment, the end leg member, mid-section and second end leg member of the support assemble are rigidly connected together. In one aspect of this embodiment, the end leg member, the mid-section and second end leg member are formed from a common piece of material.

In still another embodiment, the lift mount is angularly oriented on the support assembly to reduce stress on the connection between the support assembly and the lift mount assembly. In still yet another embodiment, the lift mount assembly is connected to the support assembly to allow the lift mount assembly to be angularly adjustably connected to the support assembly. In this embodiment, adjustable connection enables the lift mount assembly to be used with a variety of different vehicles. In one specific embodiment, the adjustable connection can be formed by a tooth and groove arrangement, a pin arrangement, a bolting arrangement, a latch arrangement, or the like.

In accordance with still yet another aspect of the present invention, the lift mount assembly includes a plow blade stop designed to receive a portion of the plow blade when the plow blade is in the lifted position and/or when the support assembly is detached from the frame mount assembly and resting on the blade mount assembly. In one embodiment, the stop provides a resting surface for the plow blade and/or can be designed to assist in mounting the lift mount assembly and support assembly to and/or from the frame mount assembly. In another embodiment, the stop plate is designed to provide structural support and add rigidity to the lift mount assembly.

In accordance with still yet another aspect of the present invention, the lift mount assembly includes an adjustable lift arm. The height of the lift arm can be adjusted so as to accommodate a variety of different vehicles and/or increase the efficiency and operation of the lift mount assembly. In still another embodiment, the lift arm is connected in a singular angular orientation with respect to the legs. In a further embodiment, the lift arm is connected to enable a plurality of angular orientations with respect to the legs.

In accordance with still yet another aspect of the present invention, the blade mount assembly includes a support mechanism to elevate at least a portion of the blade assembly above a ground surface when the blade mount assembly is detached from the support assembly and/or the support assembly is detached from the frame mount assembly. The support leg enables an operator to conveniently attach and/or reattach the end of the blade mount assembly to the support assembly, and/or prevent damage to the support assembly and/or the blade mount assembly during the connecting and/or reconnecting of the blade mount assembly to the support assembly. In one embodiment, the support leg is movable between a support position and a non-support position. In the non-support position, the leg is raised and/or repositioned so as not to contact the ground surface during use of the snowplow blade. In the support position, the leg is lowered and/or repositioned so as to rest on the surface of the ground. In another embodiment, the support leg elevates one end of the blade mount assembly so that the blade mount assembly can be easily connected to and/or disconnected from the support assembly, and/or the support assembly can be easily connected to and/or disconnected from the frame mount assembly. In still another embodiment, the support leg is adjustably positionable to vary the elevation of the end of the blade mount assembly from the ground surface. The variable height positioning of the support leg can be accomplished in a variety of manners. In one specific embodiment, the support leg includes a plurality of openings whereby a bolt, pin or the like is positioned through the opening and secured in a portion of the blade mount assembly. The plurality of openings allow the support leg to support the end of the blade mount assembly in a variety of elevations above the ground. In another specific embodiment, the plurality of openings enable the support leg to be secured in a retracted position in multiple locations on the blade mount assembly. In another specific embodiment, the support leg is extended and/or retracted from the ground surface by a crank arrangement. In this embodiment, a crank is rotated to lower or raise the leg. Many arrangements which include the crank can be used to raise and lower the support leg. These arrangements can include rope, cord, chains, screws, teeth, and/or grooves. In one preferred arrangement, the leg includes a plurality of grooves that engage rotating teeth which are rotated by the crank. In another preferred arrangement, the leg is raised and lowered by a screw-jack arrangement. In another embodiment, the support leg includes a mount flange that enables the support leg to be attached and detached from the blade mount assembly. In still another embodiment, the support leg can be stored on the lift mount assembly or support assembly when not in use. In a further embodiment, the top portion of the support leg is designed as a landing to support a stop plate that is mounted onto the support assembly or lift mount assembly. In one specific embodiment, the stop plate engages the top portion of the support leg when the support assembly is disconnected from the frame mount assembly.

In accordance with a further aspect of the present invention, the lift mount assembly includes one or more auxiliary lights. When the complete snowplow mount assembly is secured to a vehicle, the headlights of the vehicle may be partially or totally blocked. In such situations, auxiliary headlights should be used. The lift mount assembly is designed to enable one or more auxiliary lights to be connected to the lift mount assembly. In one embodiment, the one or more legs of the lift mount assembly include a connector location designed to connect to an auxiliary light and/or mount to an auxiliary light. In a specific embodiment, the legs of the lift mount assembly include a plurality of connector locations. The plurality of connectors allow the auxiliary lights to be used in association with a wide variety of vehicles. In another specific embodiment, the connector locations are openings in the legs to allow a pin, bolt or the like to be inserted there through.

In accordance with still another aspect of the present invention, the blade mount assembly and/or blade support includes a skid plate and/or coasters. In one embodiment, the skid plate and/or coasters are secured to or near the front of the blade mount assembly and/or blade support. In another embodiment, the skid plate and/or coasters elevate at least one end of the blade mount assembly and/or blade support above the ground to facilitate in the attachment and/or detachment of the blade mount assembly from the support assembly, the attachment and/or detachment of the support assembly from the frame mount assembly, and/or limit or prevent damage to the frame mount assembly during operation of the snowplow. In yet another embodiment, the skid plate and/or coasters are adjustably secured to the blade mount assembly and/or blade support so that the height of at least one end of the blade mount assembly and/or blade support can be adjusted from the ground.

In accordance with still yet another: aspect of the present invention, there is provided a snowplow mount arrangement wherein the blade mount assembly and/or the lift mount assembly can be easily connected and/or disconnected from the vehicle. In such an arrangement, a support assembly connects to both the blade mount assembly and the lift mount assembly such that the whole unit can be easily removed and/or a portion of the unit can be easily removed from the vehicle as desired. In one preferred arrangement, the simple removal of one or two bolts or pins from the support assembly disengages the blade mount assembly from the support assembly. In another embodiment, the simple removal of a few bolts or pins from the support assembly results in the detachment of both the blade mount assembly, the lift mount assembly and the support assembly from the frame mount assembly. The components of the support assembly, lift mount assembly and blade mount assembly can be oriented so that when the components are completely removed from the frame mount assembly, they can be easily stored for later use and reattachment.

In accordance with a further aspect of the present invention, there is provided a scraper blade having a reinforced edge. The reinforced edge is designed to extend the life of the scraper blade as the scraper blade moves over a ground surface. In one embodiment, the reinforced edge includes a durable material embedded in the bottom of the scraper blade. A variety of durable materials can be used such as, but not limited to, metal, Kevlar, carbon fibers, etc.

It is accordingly a primary object of the present invention to provide improvements in the connection of snowplow mount assemblies to the front end of a vehicle for elevating and/or lowering a plow blade mounted on a vehicle.

Another object of the present invention is the provision of an assembly which reduces stresses applied to the vehicle frame and/or supporting portions of the assembly when the snowplow blade is elevated.

A further object of the present invention is the provision of an assembly which enables quick release and/or removal of the components of the assembly from the vehicle.

Still yet another object of the present invention is the provision of an assembly which is independent of the vehicle bumper.

Still yet a further object of the present invention is the provision of an assembly in which the structure and location of the frame mount assembly relative to the bumper and/or vehicle body promotes the aesthetic value of the front end of the vehicle during non-snowplow use when the plow blade lift unit and/or the plow mount attachment are disconnected from the vehicle.

Still another object of the present invention is the provision of a frame mount assembly which is positioned behind the vehicle bumper to minimize and/or eliminate the projection of the components forwardly of the front of the bumper.

Yet a further object of the present invention is the provision of an assembly which has a lighter weight structure and/or which has a structural integrity to properly support a snowplow blade in an elevated and/or unelevated position and which promotes the life of the components and/or minimizes maintenance and/or replacement costs of the components of the assembly.

Another object of the present invention is the provision of an assembly which enables the operator to easily connect and/or disconnect various components of the assembly from the vehicle.

A further object of the present invention is the provision of an assembly which enables the attachment and/or detachment of the lift mount assembly, support assembly and/or blade mount assembly in a safe, sufficient, and/or convenient manner.

It is still yet another object of the present invention the provision of providing improvements in an assembly mountable on a vehicle for elevating and/or lowering the plow blade.

Another and/or alternative object of the present invention is the provision of an assembly which enables quick release of the support assembly from the frame mount assembly during periods of non-snowplow use of the vehicle.

Still another and/or alternative object of the present invention is the provision of an assembly which enables quick release and/or removal of snowplow components and at the same time protects against unintentional separation of component parts during snowplow operation.

Still yet another and/or alternative object of the present invention is the provision of an assembly which structural location of the frame mount assembly in relation to the bumper of the vehicle promotes safety of the vehicle during non-snowplow use of the vehicle when the support assembly is removed.

Still yet a further and/or alternative object of the present invention is the provision of an assembly which is less expensive to manufacture.

Still yet another and/or alternative object of the present invention is the provision of an assembly which includes a support assembly that connects to the lift mount assembly and/or the blade mount assembly to increase the simplicity of removal and/or attachment of such components to the vehicle.

Yet another and/or alternative object of the present invention is the provision of a lift arm on the lift mount assembly which height can be adjusted to accommodate a variety of different vehicles.

Still yet another and/or alternative object of the present invention is the provision of a support leg on the lift mount assembly which elevates an end of the blade mount assembly to simplify the ease of connecting and/or disconnecting components to the vehicle and/or to prevent damage of one or more components of the assembly.

Another and/or alternative object of the present invention is the provision of a blade mount assembly that includes a skid plate and/or coasters Yet another and/or alternative object of the present invention is the provision of a support leg that can easily adjust the height of at least one end of a blade mount assembly and which support leg can be easily and conveniently stored during non-use.

Still another and/or alternative object of the present invention is the provision of a snowplow mount assembly that includes auxiliary lights mountable to the snowplow mount assembly.

Still yet another and/or alternative object of the present invention is the provision of a snowplow mount assembly which includes connectors that are easy to handle and which are biased to facilitate in the securing together of one or more components of the snowplow mount assembly.

A further and/or alternative object of the present invention is the provision of a snowplow mount assembly which includes a blade mount assembly that controls the movement of the snowplow blade about a horizontal axis.

Yet a further and/or alternative object of the present invention is the provision of a snowplow mount assembly which includes a blade mount assembly that allows movement of the snowplow blade about a vertical axis to accommodate uneven road surfaces.

Still yet a further and/or alternative object of the present invention is the provision of a snowplow mount assembly which includes a blade mount assembly and/or blade support that have one or more grease or lubrication fittings to facilitate in the movement of the snowplow blade relative to the blade mount assembly.

A further and/or alternative object of the present invention is the provision of a snowplow mount assembly which includes a scraper blade having a reinforced edge to extend the life of the scraper blade.

These and other objects and advantages will become apparent from the following description taken together with the accompanied drawings.

BRIEF DESCRIPTION OF THE DRAWINGS

The invention may take physical form in certain parts and arrangements of parts, a preferred embodiment of which will be described in detail and illustrated in the accompanied drawings which form a part hereof and wherein.

DETAILED DESCRIPTION OF THE PREFERRED EMBODIMENT OF THE INVENTION

Figure 1:
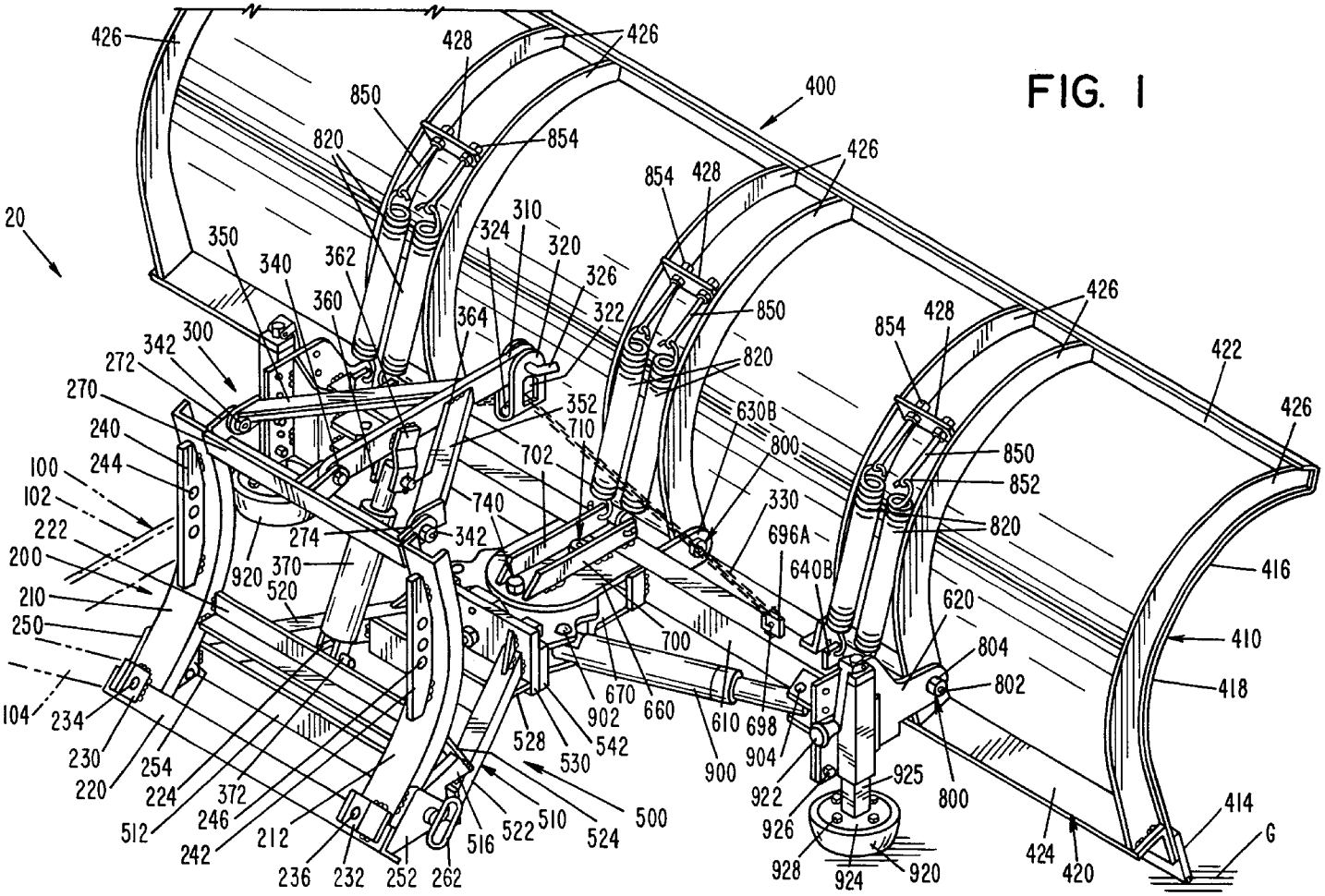
FIG. 1 is a perspective view of the frame mount assembly in accordance with the present invention.

Referring now to the drawings wherein the showings are for the purpose of illustrating preferred embodiments of the invention only and not for the purpose of limiting the same, FIGS. 1–10 illustrate an improved frame mount assembly for operating a snowplow with the use of a vehicle. The frame mount assembly is suitable for use with large trucks, pick-up trucks, 4×4 vehicles, SUV's, and the like for snow removal operations such as encountered in plowing driveways, parking lots, roads, etc. These snowplow blades are typically about 50–85 inches in length. For snowplow blades used in heavy duty snowplow removal, such as by municipalities and government agencies for removing snow and debris from highways, the snowplow blade typically has a length of about 80–120 inches.

The frame mount assembly 20 is made up of several principal components, namely the housing mount 100, which is secured to the frame members of a vehicle 30 and positioned under and rearwardly of the vehicle bumper 32, a support assembly 200 secured to the housing mount, blade mount assembly 500 secured to the support assembly and blade support 400, and a lift mount assembly 300 which is also secured to the support assembly.

Figure 2:
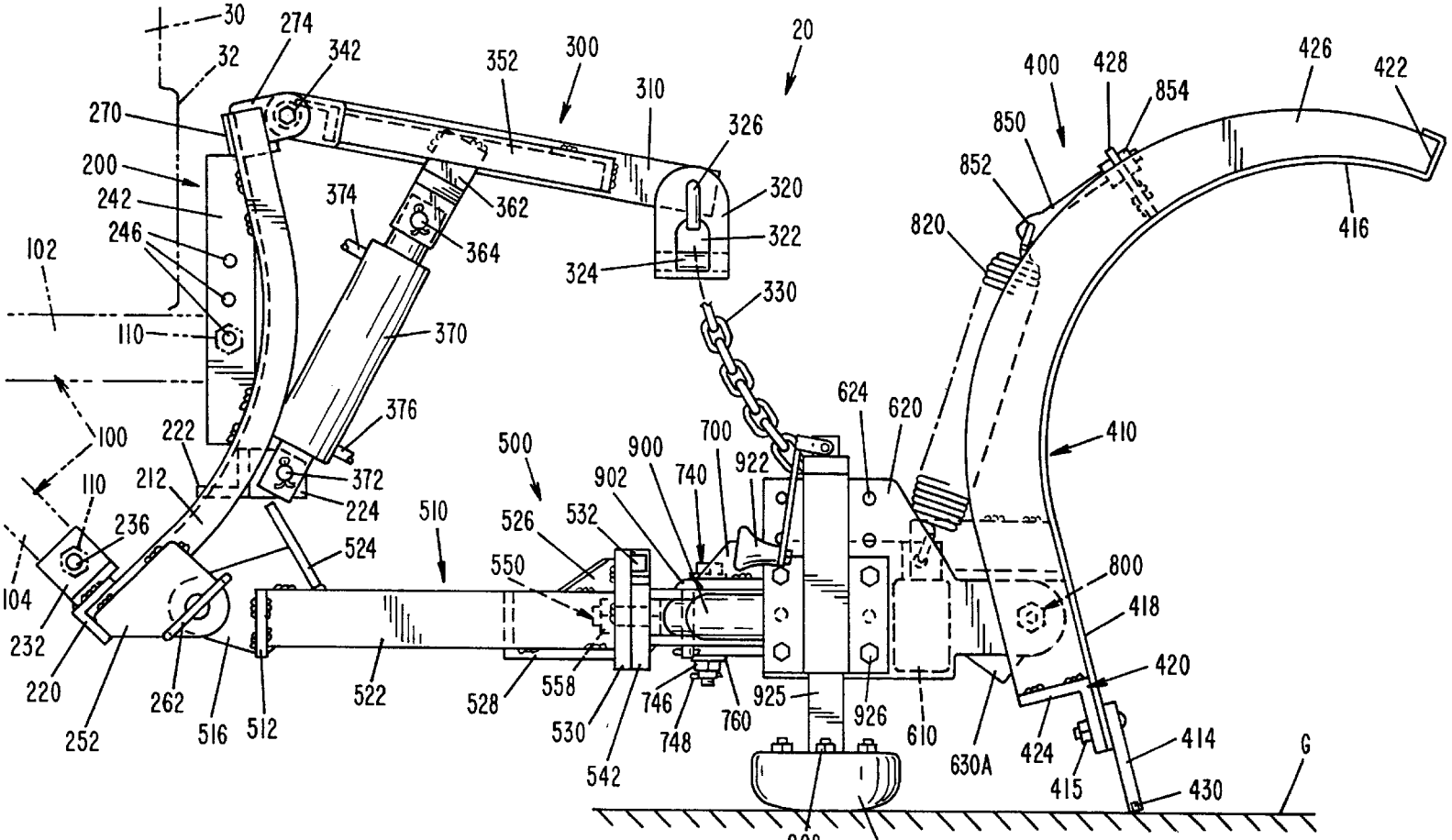
FIG. 2 is a side view of the frame mount assembly as shown in FIG. 1.

Referring now to FIG. 2, housing mount 100 is partially shown as being secured to the underside of the vehicle 30. Housing mount 100 includes two struts 102, 104 that are connected to the frame of the vehicle and are designed to be connected to support assembly 200. As shown in FIG. 2, bolts 110 are used to secure the support assembly to the housing mount.

Figure 3:
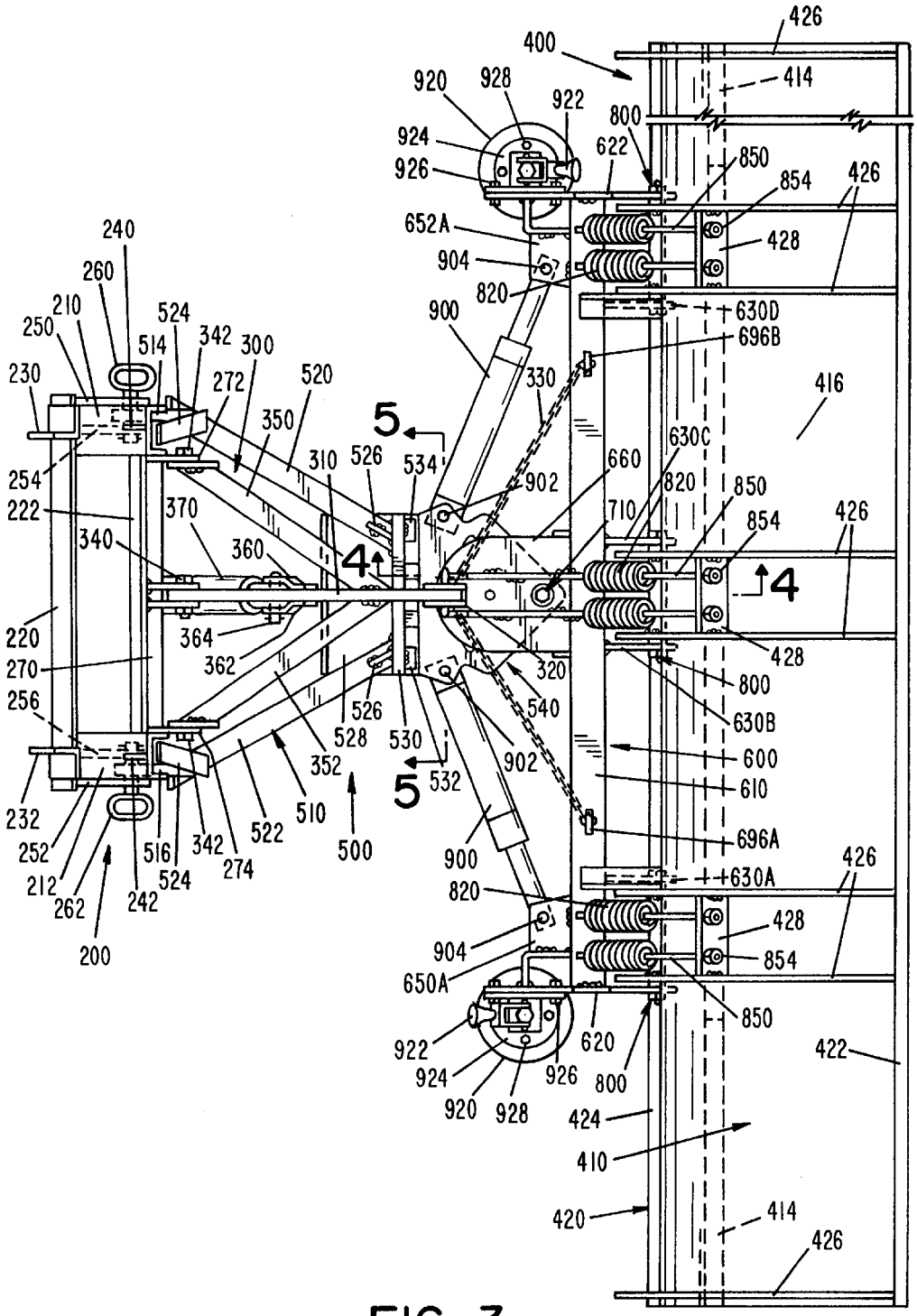
FIG. 3 is a top view of the frame mount assembly as illustrated in FIG. 1.

Referring now to FIGS. 1–3, support assembly 200 includes a pair of arcuate U-shaped support bars 210, 212. The support bars are rigidly held in a spaced relationship to one another by two L-shaped reenforcement bars 220, 222 welded at the lower ends of the support bars and intermediate of the length of the support bars, respectively. The arcuate support bars are designed to curve around the front of the vehicle, as shown in FIG. 2. Welded to a portion of reenforcement bar 220 and the bottom of support bars 210, 212 are two connection flanges 230, 232 designed to connect to struts 104 of housing mount 100. Each connection flange includes an opening 234, 236 adapted to receive bolt 110. Also welded to the back side of support bars 210, 212 are attachment flanges 240, 242. Attachment flanges each have a plurality of openings 244, 246 designed to receive bolt 110 when being connected to struts 102 of housing mount 100. Openings 244, 246 can also be.used to attach auxiliary lights, not shown, to the support assembly. Attachment flanges also create structural strength to the support bars. Welded to the outer lower ends of each support bar are attachment flanges 250, 252. Each attachment flange includes an opening designed to receive an attachment pin 260, 262. A secondary attachment flange 254, 256 is welded adjacent to attachment flanges 250, 252, respectively. Secondary attachment flanges 254, 256 also include an opening to receive a portion of pin 260, 262, as shown in FIG. 3. Welded between the upper ends of support bars 210, 212 is an upper support rail 270. Two connection tabs 272, 274 protrude outwardly from upper support rail 270. Each connection tab includes an opening designed to connect to a portion lift mount assembly 300. A mount tab 224 is secured to reenforcement bar 222 to mount a portion of lift mount assembly 300 to the support assembly.

Referring again to FIGS. 1–3, there is shown the lift mount assembly 300. Lift mount assembly 300 includes a lift leg 310 centrally positioned between connection tabs 272, 274. Connected to the end of lift leg 310 is a hook 320. Hook 320 includes an opening 322 and a hardened rod 324. The hardened rod allows lift chain 330 to slide over the rod as the chain moves through opening 322. This design enables the chain to move freely move and better adjust to the movement of the snowplow blade as the snowplow blade moves over a ground surface. Hook 320 is connected to lift leg 310 by a pin 326. Pin 326 can be removed to release hook 320 from the lift leg. The opposite end of 310 is connected by hinge 340 to upper support rail 270. Hinge 340 allows the end of lift leg 310 to move up and down. Two reenforcement beams 350, 352 are connected between the lift leg and the support bar to provide strength and rigidity. The two reenforcement beams are also hingably connected by hinge 342 to upper support rail 270. Two attachment tabs 360, 362 are connected to a mid portion of the lift leg to provide a connection for the hydraulic lift 370. Each attachment tab includes an opening adapted to receive a removable pin 364 that connects one end of the hydraulic lift 370 to the lift leg. The other end of hydraulic lift 370 is connected by pin 372 to mount tab 224. Hydraulic lift 370 includes two fluid openings 374, 376 to receive hydraulic fluid for operation of the hydraulic lift.

Figure 9:
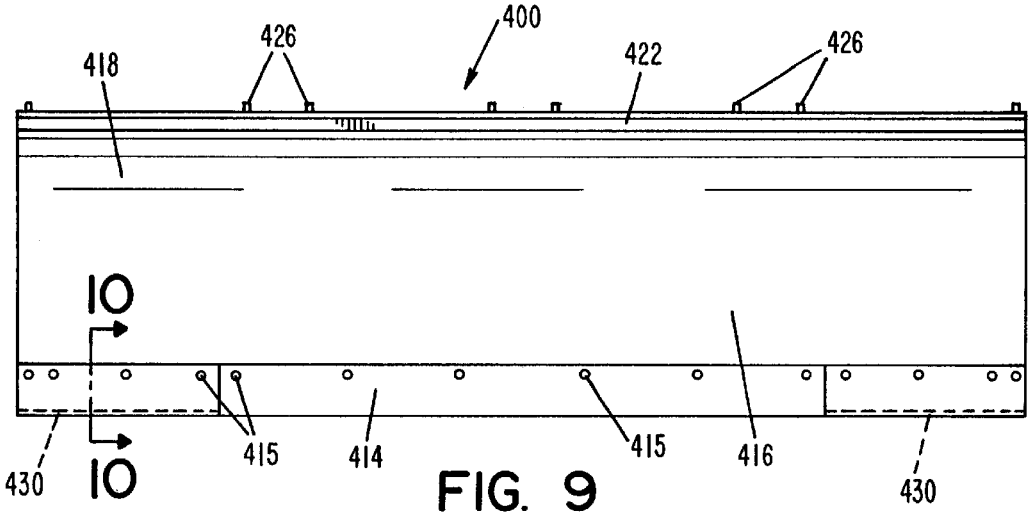
FIG. 9 is a front elevational view of the snowplow blade of FIG. 1.
Figure 10:
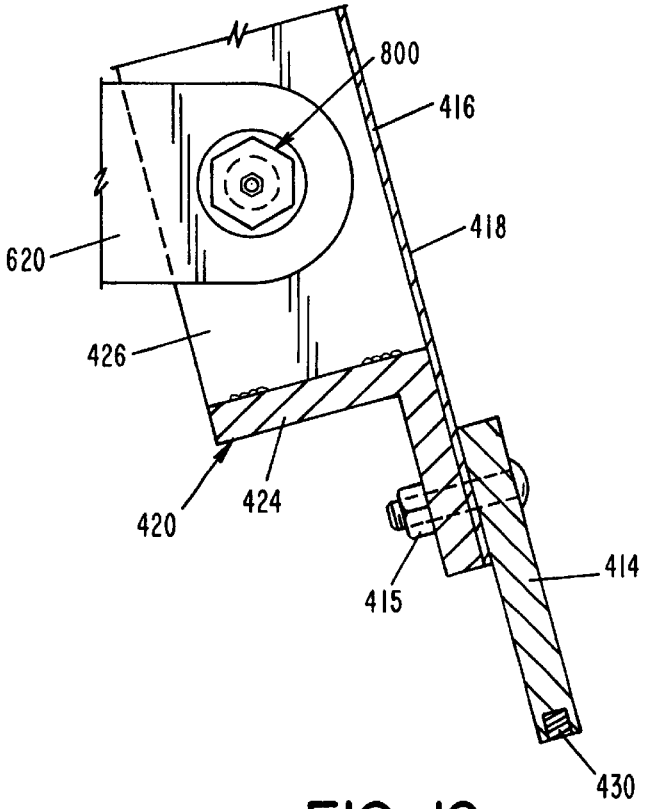
FIG. 10 is cross-sectional view taken along line 10—10 of FIG. 9.

Referring again to FIGS. 1–3, blade support 400 includes a plow blade 410 having a generally longitudinally extending structural frame 420, a scraper blade 414, which is bolted by bolts 415 to the bottom of structural frame 420, and an inwardly curved mold board 416. Structural frame 420 includes upper and lower flanges 422, 424 that extend the complete length of the mold board. Several curved structural ribs 426 extend between the upper and lower flanges. Connected to several pairs of structural ribs are connection flanges 428 designed to secure tension springs to the plow blade. For consistency of terminology as used herein, the scraper blade is the replaceable, lower edged portion of the plow blade, and the blade is the inwardly curved front face 418 of mold board 416 and the scraper blade 414. Plow blade 410 includes a structural frame 420, mold board 416 and scraper blade 414. Referring now to FIGS. 9 and 10, a portion of the base of the plow blade is illustrated. Scraper blade 414 is shown to include a reinforced edge to extend the life of the scraper blade as the scraper blade moves over ground surface G. The reinforced edge includes a durable material 430 embedded in the bottom of the scraper blade. As can be appreciated, a variety of durable materials can be used. One such material is a carbide insert. In addition, it can be appreciated that the scraper blade can be used without a reinforced edge.

Secured between blade support 400 and support assembly 200 is the blade mount assembly 500. Referring still again to FIGS. 1–3, and to FIG. 7, blade mount assembly includes an A-frame 510. The A-frame includes a support cross-over arm 512 having journals 514, 516 connected to the two ends of the cross-over arm. The two journals include journal openings 518 adapted to secure the A-frame to attachment flanges 250, 252 of support assembly 200. The A-frame also includes two struts 520, 522 which are connected at one end to the cross-over arm 512 and at the other end to a mount block 530. The A-frame also includes support flanges 526, 528 to provide structural rigidity between the struts and the mount block. The A-frame further includes stop flanges 524 connected to the struts and adjacent the two journals. The stop flanges are designed to limit the upward position of the blade mount assembly when being lifted by the lift mount assembly.

Figure 7:
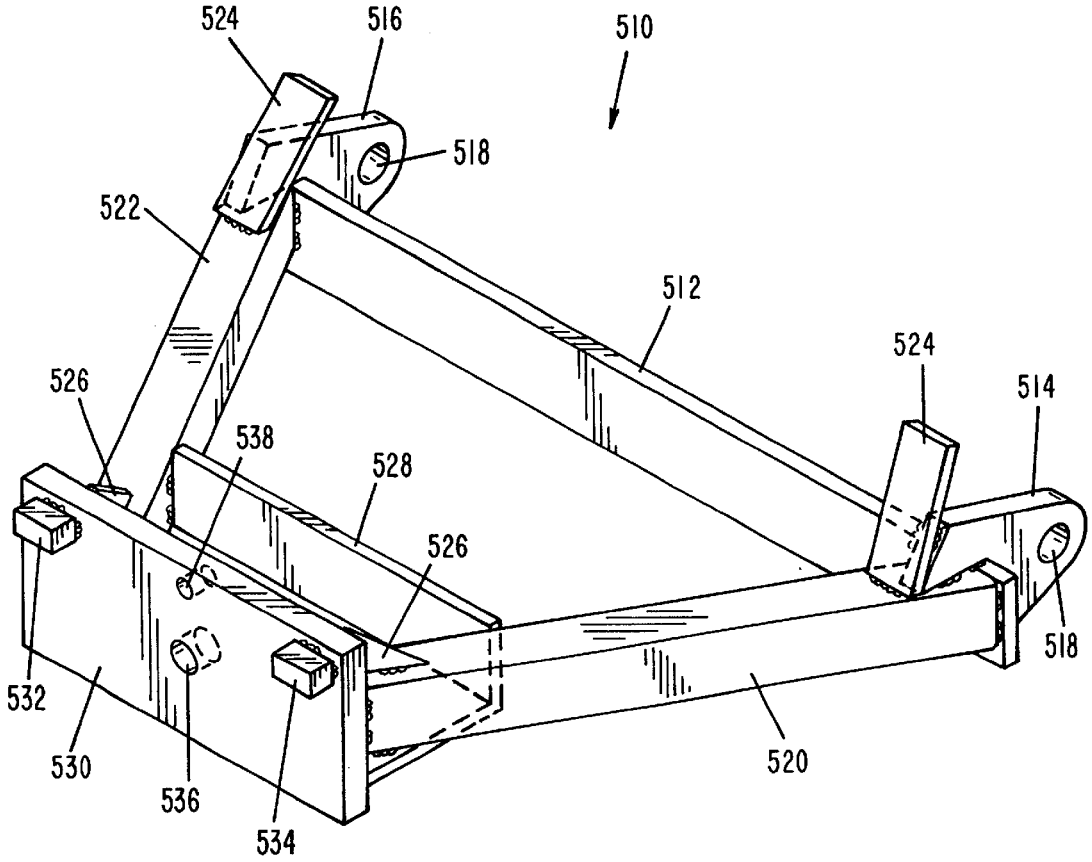
FIG. 7 is a perspective view of the blade mount assembly absent the front portion.

As shown in FIG. 7, the front face of the mount plate includes two limit blocks 532, 534. The limit blocks are designed to limit the rotational movement of the connection block 540 when connected to the mount block. The front face of the mount plate also includes amount opening 536 and a lock opening 538. Mount opening 536 is designed to receive a connection bolt 550 of connection block 540 which is used to secure the connection block to the mount plate. Lock opening 538 is designed to receive a lock bolt 564 that inhibits or prevents any rotational movement of the connection block 540 when connected to the mount block as shown in FIG. 4.

Figure 6:
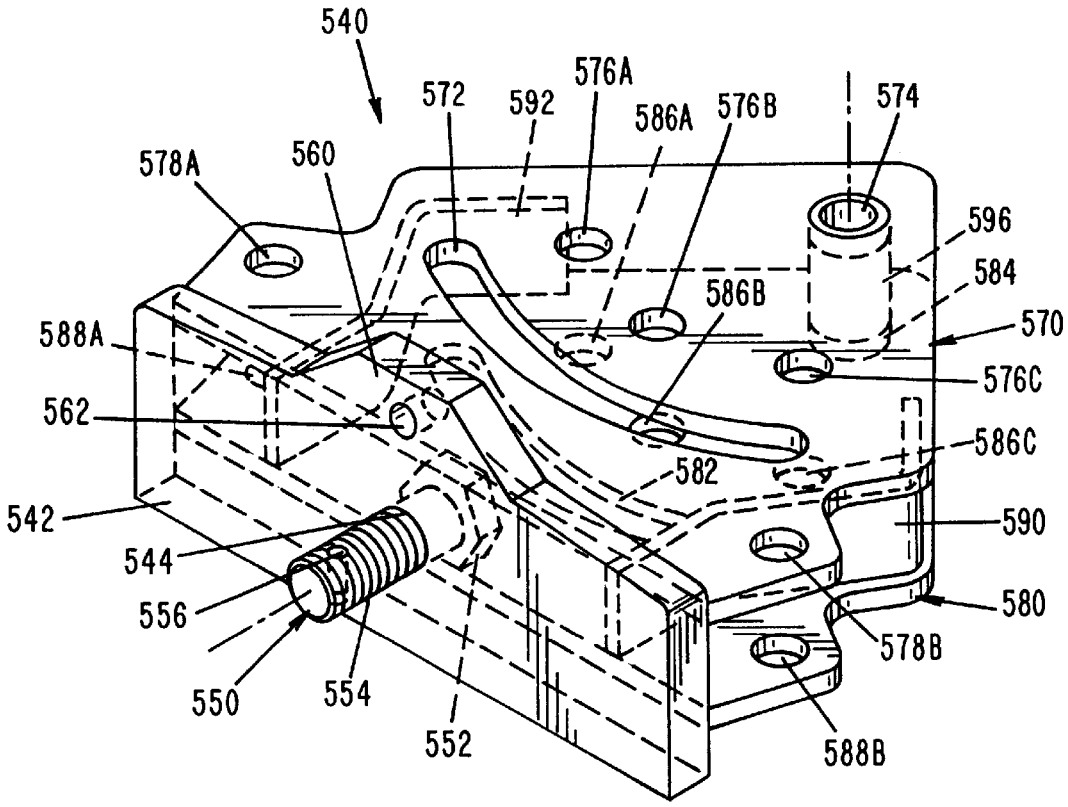
FIG. 6 is a perspective view of the front portion of the blade mount assembly.

Connection block 540 is best shown in FIG. 6. Connection block 540 includes a back plate 542 that includes a central opening 544 adapted to receive bolt 550. Bolt 550 includes a head 552 that is sized to prevent the head from passing through opening 544. Bolt 550 also includes a body 554 and a pin opening 556 in the body. Pin opening 556 is adapted to receive a lock pin 558. Lock pin 558 is designed to prevent a nut 559 that is threaded onto bolt 550 from becoming unthreaded from the bolt, as shown in FIG. 4. Secured to the top edge of back plate 542 is a fix tab 560 that includes an opening 562. The fix tab has a generally trapezoidal shape; however, other shapes can be used. Secured to the front face of the back plate are two connector plates 570, 580. The connector plates have a similar arrow head shape and lie in the same horizontal plane in a space relationship from one another. Two spacing bars 590, 592 are connected between the connector plates to maintain the plate spacing and to provide strength and rigidity to the two plates. Each of the connector plates include symmetrically oriented guide slots 572, 582, mount openings 574, 584, fix openings 576A–C, 586A–C, and ram openings 578A–B, 588A–B as shown in FIG. 6. Positioned between mount openings 574, 584 is a support tube 596 which facilitates in maintaining the plate spacing and provides strength and rigidity to the two plates.

Figure 8:
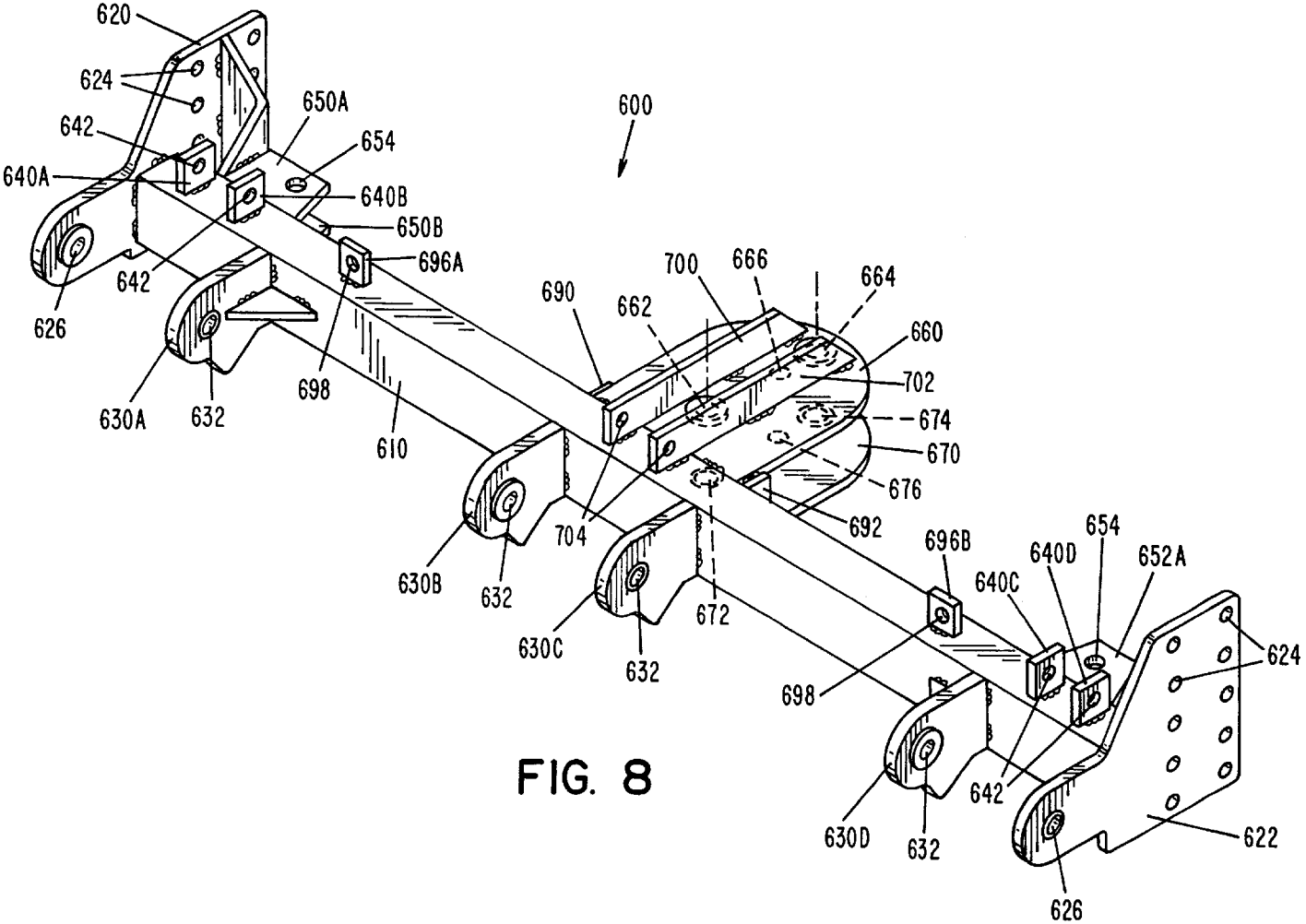
FIG. 8 is a perspective view of the blade support absent the snowplow blade.

A blade mount bar 600 is illustrated in FIG. 8. The blade mount bar is designed to be secured to the plow blade and connected to connection block 540. Blade mount 600 includes a mount bar 610 having an end flange 620, 622 connected at each end of the bar. Each end flange includes three pairs of runner openings 624 and a blade mount opening 626. Blade mount bar also includes four blade flanges 630A–D connected to the front face of the blade mount. Each of the blade flanges includes a blade mount opening 632. Connected to the top surface of mount bar 610 are six spring tabs 640A–D. Each of the spring tabs includes an opening 642. Welded to each back face end of the mount bar are a pair of rigidity flanges 650A–B, 652A–B. Each pair of rigidity flanges includes a ram opening 654. The rigidity flanges provide rigidity and strength to the connection between the end flanges and mount bar and also provide a mount location for the rams on the blade mount bar. Also connected to the back face of the mount bar are a pair of U-shaped plates 660, 670 symmetrically oriented with respect to one another. The spacing between U-shaped plates 660, 670 enables connector plates 570, 580 to be inserted therebetween, as shown in FIG. 4. Two side flanges 690, 692 facilitate in maintaining the spacing of the U-shaped plates and provides structural strength and rigidity to the U-shaped plates. Two support flanges 700, 702 are connected between the top surface of the mount bar to the top surface of U-shaped plate 660. The support flanges each include an opening 704. Referring again to the two U-shaped plates, each U-shaped plate includes several openings, namely pivot openings 662, 672, guide openings 664, 674, and lock openings 666, 676. Blade mount 600 further includes chain tabs 696A–B each having an opening 698. One end of chain 330 connects to openings 698.

Figure 4:
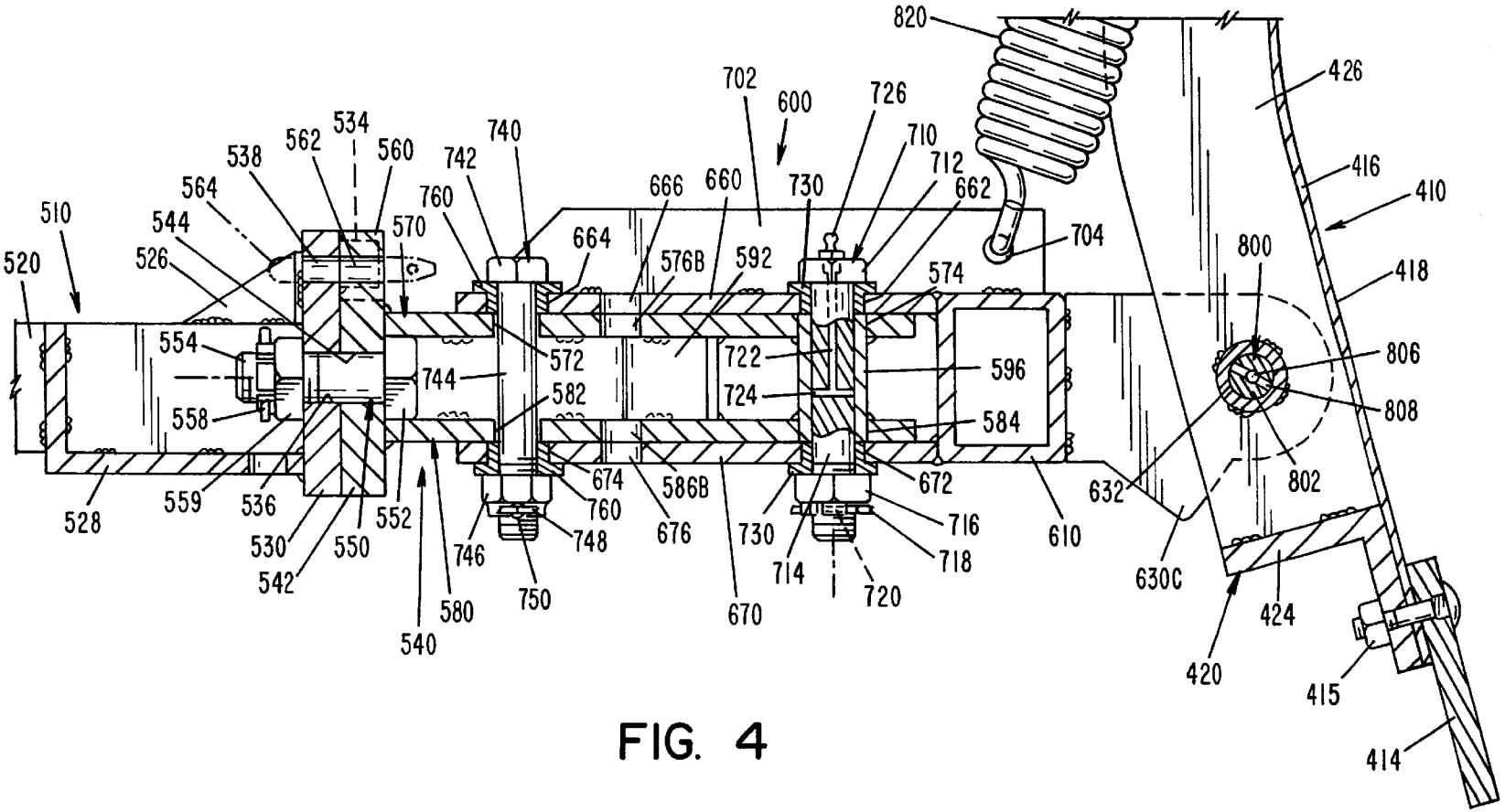
FIG. 4 is an enlarged cross-sectional view taken along line 4—4 of FIG. 3.

Referring now to FIG. 4, blade mount bar 600 is illustrated as being connected to connection block 540. Pivot bolt 710 is shown as connecting the U-shaped plates to the connector plates. Pivot bolt 710 includes a head 712 having a size that prevents the head from passing through opening 662 of U-shaped plate 660. Body 714 of the bolt passes through opening 662, opening 574 of connector plate 570, opening 584 of connector plate 580, and opening 672 of U-shaped plate 670. Nut 716 is shown to be treaded onto the end of body 714. A lock pin 718 is inserted through a pin hole 720 of body 714 to retain nut 716 on the body of the bolt. The body of pivot bolt 710 is also shown to be inserted in a bushing 730. The bushing facilitates in the pivoting movement of the U-shaped plates relative to the connector plate. Pivot bolt 710 is also disclosed as including a lubricant passage 722 that passes through head 712 and into body 714. Lubricant passage 722 includes side passages 724 that direct lubricant to the space between bushing 730 and the outer surface of body 714. A removable cap 726 is used to seal the opening to the lubricant passage in the head of the pivot bolt. The removable cap enables an operator to remove the cap to insert lubricant in the lubricant passage when need and to then reseal the opening. The lubricant facilitates in the pivoting movement of the U-shaped plates relative to the connector plate. A swivel bolt 740 is shown as allowing partial pivoting of the U-shaped plates on the connector plates. Swivel bolt 740 includes a head 742 having a size that prevents the head from passing through opening 664 of U-shaped plate 660. Body 744 of the bolt passes through opening 664, slot 572 of connector plate 570, slot 582 of connector plate 580, and opening 674 of U-shaped plate 670. Nut 746 is shown to be treaded onto the end of body 744. A lock pin 748 is inserted through a pin hole 750 of body 744 to retain nut 746 on the body of the bolt. The body of pivot bolt 740 is also shown to be inserted in a bushing 760. The bushing facilitates in the pivoting movement of the U-shaped plates to the connector plates. As can be appreciated, the size of the slots in the connector plates limits the, amount of pivoting of the U-shaped plates on the connector plates.

Referring now to FIGS. 1, 2 and 4, blade support 400 is connected to blade mount bar 600 by several bolts 800. Bolts 800 are designed to pivotly connect curved structural ribs 426 to end flanges 620, 622 and blade flanges 630A–D. Bolt 800 includes a head having a size such that the head cannot pass through the opening in structural ribs 426. Bolt 800 also includes a body that passes through the opening in the structural ribs and through opening 632 of blade flanges 630 or 626 of the end flanges. A nut 804 is threaded to the end of body 802. As shown in FIG. 4, bolts 800 include an internal passageway 806 and side passageway 808 to allow a lubricating agent to provide lubrication about the bolt and facilitate in the pivotal movement of the snowplow blade on the blade mount bar. Several retaining coils 820 are also connected between blade support 400 and blade mount bar 600. One end of the coil is connected in opening 704 of support flanges 700, 702 or openings 642 of spring tabs 640A–D. The other end of the coil is connected to opening 852 on one end of tension rod 850. The other end of tension rod 850 is connected by nuts 854 to connection flanges 428 on the snowplow blade. The nuts 854 are used to adjust the tension provided by the coils.

Referring now to FIG. 1, rams 900 are connected between openings 578A–B, 588A–B of connection block 540 and openings 654 of blade mount bar 600. Pins 902 and 904 are used to connect the rams to openings 578A–B, 588A–B and openings 654. Also illustrated in FIGS. 1 and 2 are a pair of mushroom runners 920 that are connected to runner openings 624 of blade mount bar 600. The top of the runner includes a handle 922 that can be raised and rotated to adjust the height of the runners. Runners 920 are connected to openings 624 by bolts 926. The base 924 of the runner is connected to shaft 925 by bolts 928. The runners are used to stabilize the snowplow blade during operation and to help minimize damage to the bottom of the snowplow blade. As can be appreciated, the use of ruiners is optional and the snowplow blade can be used without the use of runners.

The operation of the frame mount assembly will now be described. The basic operation of the frame mount assembly is shown and described in detail in co-pending U.S. patent application Ser. Nos. 09/215,812 filed Dec. 18, 1998; 09/449,945 filed Nov. 29, 1999; and 09/465,887 filed Dec. 17, 1999, thus will not be repeated. Reference will now be made to FIGS. 4–8 wherein the novel connection between the snowplow blade and blade mount assembly 500 is illustrated. The novel connection enables the snowplow blade to pivot in a horizontal axis or in a plane substantially parallel to ground G. This pivoting action is enabled by the connection between connection block 540 and blade mount bar 600. As previously described, bolt 710 pivotly connects the blade mount bar to the connection block. Bolt 740 slides in slot 572 thereby enabling the blade mount bar to pivot a controlled distance. As can be appreciated, the design and size of slot 572 can be selected to control the amount and/or direction of pivot of the blade mount bar to the connection block when being used in certain applications. When it is undesirable to allow the blade mount bar to pivot relative to the connection block, a lock bolt can be inserted in one of the openings 576A–C, 586A–C, 666, and 676. The use of the lock bolt will lock the snowplow blade in a left pivot when the bolt is inserted through openings 576C, 586C, 666, and 676; a right pivot when the bolt is inserted through openings 576A, 586A, 666, and 676; and a front central position when the bolt is inserted through openings 576B, 586B, 666, and 676.

Figure 5:
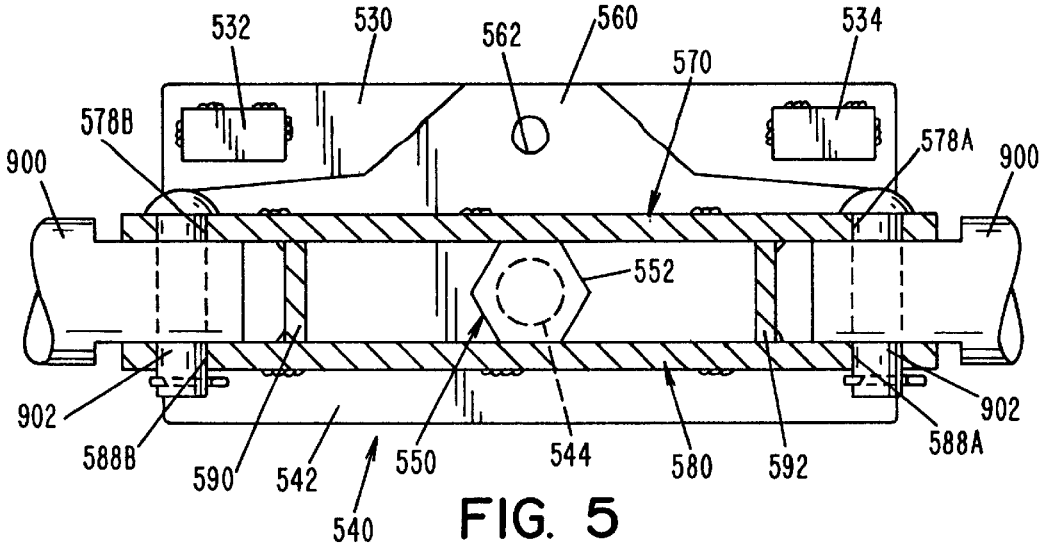
FIG. 5 is an enlarged cross-sectional view taken along lines 5—5 of FIG. 3.
Figure 5A:
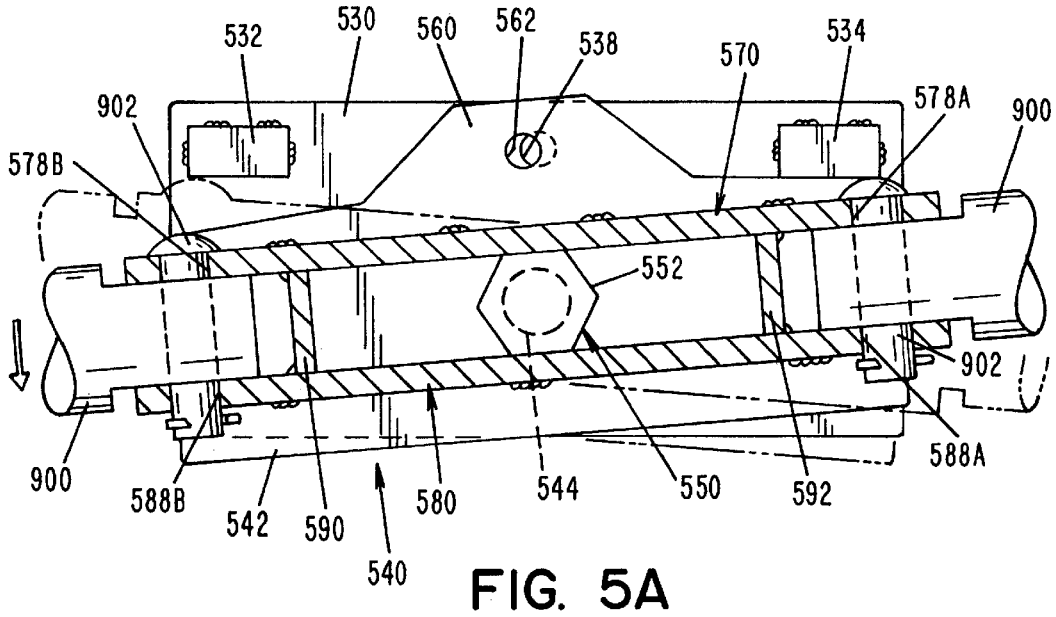
FIG. 5A is a modified view of FIG. 5 illustrating the front portion of the blade mount assembly slightly rotated relative to another portion of the blade mount assembly.

Referring now to FIGS. 5A and 5B, the connection between connection block 540 and mount block 530 enables the connection block to pivot about bolt 550. This pivoting action enables the snowplow blade to slightly rotate about an axis that is substantially transverse to the ground G. This slight amount of rotation allows the snowplow blade outer edges to lift off an uneven ground surface thus reducing damage and wear to the scraper blade. FIG. 5 illustrates the connection block being substantially aligned with the blade mount assembly. In this position, the scraper blade on the snowplow blade is substantially parallel to ground G. A bolt can be inserted through openings 562 and 538 to lock the connection block in this position relative to the A-frame 510. As shown in FIG. 5A, connection block 540 is in a rotated position relative to mount block 530. Limit block 534 is shown as limiting the rotation of the connection block. The dotted lines illustrates limit block 532 limiting the rotation of the connection block in the opposite direction. Typically, the limit blocks are positioned to allow for up to about 5° rotation; however, other maximum angles of rotation can be used.

The novel interconnection of the connection block to the mount block, and the connection block to the blade mount bar, enables the snowplow blade to move and/or be positioned in a desired orientation as the snowplow blade travels over the ground. In addition, the snowplow blade can better orient itself to the ground surface during operation thereby improving the performance of the snowplow blade and reducing damage and wear to the snowplow blade especially when removing materials from an uneven ground surface.

The invention has been described with reference to preferred and alternate embodiments. Modifications and alterations will become apparent to those skilled in the art upon reading and understanding the detailed discussion of the invention provided for herein. This invention is intended to include all such modifications and alterations insofar as they come within the scope of the present invention.

Having thus described the invention, it is claimed:

1. A snowplow blade mount assembly mountable on a vehicle comprising a blade mount assembly connected to a snowplow blade, said blade mount assembly including a blade mount frame and a connection block, said connection block rotatable on said blade mount frame to rotate in a rotation plane, said snowplow blade interconnected to said connection block to allow said snowplow blade to laterally move in a lateral plane, said lateral plane different from said rotation plane thereby enabling said snowplow blade to move in multiple planes relative to said blade mount frame.

2. The assembly as defined in claim 1, wherein said lateral plane is substantially perpendicular to said rotation plane.

3. The assembly as defined in claim 1, wherein said connection block limits movement of said snowplow blade in said lateral plane.

4. The assembly as defined in claim 2, wherein said connection block limits movement of said snowplow blade in said lateral plane.

5. The assembly as defined in claim 3, wherein said connection block includes a slot arrangement that limits movement of said snowplow blade in said lateral plane.

6. The assembly as defined in claim 4, wherein said connection block includes a slot arrangement that limits movement of said snowplow blade in said lateral plane.

7. The assembly as defined in claim 1, wherein said connection block includes a lateral connector that at least partially interconnects said connection block to said snowplow blade, said lateral connector defining an axis of lateral movement of said snowplow blade in said lateral plane.

8. The assembly as defined in claim 6, wherein said connection block includes a lateral connector that at least partially interconnects said connection block to said snowplow blade, said lateral connector defining an axis of lateral movement of said snowplow blade in said lateral plane.

9. The assembly as defined in claim 5, wherein said connection block includes a lateral connector that at least partially interconnects said connection block to said snowplow blade, said lateral connector defining an axis of lateral movement of said snowplow blade in said lateral plane.

10. The assembly as defined in claim 7, wherein said lateral connector includes at least one lubrication fitting to controllably supply a lubricant on an outer surface of said lateral connector to facilitate in said lateral movement of said snowplow blade.

11. The assembly as defined in claim 8, wherein said lateral connector includes at least one lubrication fitting to controllably supply a lubricant on an outer surface of said lateral connector to facilitate in said lateral movement of said snowplow blade.

12. The assembly as defined in claim 9, wherein said lateral connector includes at least one lubrication fitting to controllably supply a lubricant on an outer surface of said lateral connector to facilitate in said lateral movement of said snowplow blade.

13. The assembly as defined in claim 1, wherein said connection block only partially rotatable on said blade mount frame.

14. The assembly as defined in claim 11, wherein said connection block only partially rotatable on said blade mount frame.

15. The assembly as defined in claim 9, wherein said connection block only partially rotatable on said blade mount frame.

16. The assembly as defined in claim 13, wherein said blade mount frame includes at least one limitor to prevent fully rotation of said connection block.

17. The assembly as defined in claim 14, wherein said blade mount frame includes at least one limitor to prevent fully rotation of said connection block.

18. The assembly as defined in claim 15, wherein said blade mount frame includes at least one limitor to prevent fully rotation of said connection block.

19. The assembly as defined in claim 1, wherein said connection block includes a rotation locking arrangement to substantially prevent rotation of said snowplow blade in said rotation plane.

20. The assembly as defined in claim 17, wherein said connection block includes a rotation locking arrangement to substantially prevent rotation of said snowplow blade in said rotation plane.

21. The assembly as defined in claim 18, wherein said connection block includes a rotation locking arrangement to substantially prevent rotation of said snowplow blade in said rotation plane.

22. The assembly as defined in claim 1, wherein said connection block includes a connection pin to releasably connect said connection block to said blade mount frame, said connection pin defining an axis of rotation of said connection block in said rotation plane.

23. The assembly as defined in claim 20, wherein said connection block includes a connection pin to releasably connect said connection block to said blade mount frame, said connection pin defining an axis of rotation of said connection block in said rotation plane.

24. The assembly as defined in claim 17, wherein said connection block includes a connection pin to releasably connect said connection block to said blade mount frame, said connection pin defining an axis of rotation of said connection block in said rotation plane.

25. The assembly as defined in claim 1, including a plurality of lateral position locking arrangements to lock said snowplow blade in a particular position in said lateral plane.

26. The assembly as defined in claim 23, including a plurality of lateral position locking arrangements to lock said snowplow blade in a particular position in said lateral plane.

27. The assembly as defined in claim 24, including a plurality of lateral position locking arrangements to lock said snowplow blade in a particular position in said lateral plane.

28. The assembly as defined in claim 1, wherein said blade mount assembly includes a blade mount bar, said blade mount bar connected to said connection block and said snowplow blade, said blade mount bar moveable in said lateral plane relative to said connection block.

29. The assembly as defined in claim 26, wherein said blade mount assembly includes a blade mount bar, said blade mount bar connected to said connection block and said snowplow blade, said blade mount bar moveable in said lateral plane relative to said connection block.

30. The assembly as defined in claim 9, wherein said blade mount assembly includes a blade mount bar, said blade mount bar connected to said connection block and said snowplow blade, said blade mount bar moveable in said lateral plane relative to said connection block.

31. The assembly as defined in claim 27, wherein said blade mount assembly includes a blade mount bar, said blade mount bar connected to said connection block and said snowplow blade, said blade mount bar moveable in said lateral plane relative to said connection block.

32. The assembly as defined in claim 28, wherein said blade mount bar is pivotably connected to said snowplow blade to allow for movement of said snowplow blade in a pivot plane, said pivot plane different from said rotation plane and said lateral plane.

33. The assembly as defined in claim 29, wherein said blade mount bar is pivotably connected to said snowplow blade to allow for movement of said snowplow blade in a pivot plane, said pivot plane different from said rotation plane and said lateral plane.

34. The assembly as defined in claim 30, wherein said blade mount bar is pivotably connected to said snowplow blade to allow for movement of said snowplow blade in a pivot plane, said pivot plane different from said rotation plane and said lateral plane.

35. The assembly as defined in claim 31, wherein said blade mount bar is pivotably connected to said snowplow blade to allow for movement of said snowplow blade in a pivot plane, said pivot plane different from said rotation plane and said lateral plane.

36. The assembly as defined in claim 32, wherein pivot plane is substantially perpendicular to said rotation plane and said lateral plane.

37. The assembly as defined in claim 33, wherein pivot plane is substantially perpendicular to said rotation plane and said lateral plane.

38. The assembly as defined in claim 1, wherein said blade mount frame is an A-frame.

39. The assembly as defined in claim 37, wherein said blade mount frame is an A-frame.

40. The assembly as defined in claim 34, wherein said blade mount frame is an A-frame.

41. The assembly as defined in claim 35, wherein said blade mount frame is an A-frame.

42. The assembly as defined in claim 1, wherein said connection block includes ram connectors adapted to connect a plurality of rams between said connection block and said snowplow blade.

43. The assembly as defined in claim 1, wherein said lift mount assembly includes at least one auxiliary light connector adapted to connect an auxiliary light to said lift mount assembly.

44. The assembly as defined in claim 1, wherein said snowplow blade includes a reinforced scraper blade.

45. The assembly as defined in claim 1, including at least one runner mounted on said blade mount assembly to vertically position said snowplow blade relative to a ground surface.

46. The assembly as defined in claim 15, wherein said runner includes a shaft with an axis extending upwardly from a base, a mushroom-shaped base mounted beneath said base, a bracket mounted on said blade mount assembly with vertically opposite top and bottom sides and engaging said shaft; and level adjusters positioned between said base and said bracket to support said bracket vertically above said base.

47. A connection block for a snowplow blade that enables a snowplow blade to at least partially move in at least two planes comprising a connection pin adapted to releasably connect said connection block to a blade mount frame and a lateral connector adapted to at least partially interconnect said connection block to a snowplow blade, said connection pin defining an axis of rotation of said connection block in a rotation plane, said lateral connector defining an axis of lateral movement of the snowplow blade in a lateral plane.

48. The connection block as defined in claim 47, including a rotation locking arrangement to substantially prevent rotation of a snowplow blade in said rotation plane.

49. The connection block as defined in claim 47, including a slot arrangement that limits movement of a snowplow blade in said lateral plane.

50. The connection block as defined in claim 48, including a slot arrangement that limits movement of a snowplow blade in said lateral plane.

51. The connection block as defined in claim 47, wherein said lateral connector includes at least one lubrication fitting to controllably supply a lubricant on an outer surface of said lateral connector to facilitate in said lateral movement of said snowplow blade.

52. The connection block as defined in claim 49, wherein said lateral connector includes at least one lubrication fitting to controllably supply a lubricant on an outer surface of said lateral connector to facilitate in said lateral movement of said snowplow blade.

53. The connection block as defined in claim 50, wherein said lateral connector includes at least one lubrication fitting to controllably supply a lubricant on an outer surface of said lateral connector to facilitate in said lateral movement of said snowplow blade.

54. The connection block as defined in claim 47, including a plurality of lateral position locking arrangements to lock a snowplow blade in a particular position in said lateral plane.

55. The connection block as defined in claim 49, including a plurality of lateral position locking arrangements to lock a snowplow blade in a particular position in said lateral plane.

56. The connection block as defined in claim 52, including a plurality of lateral position locking arrangements to lock a snowplow blade in a particular position in said lateral plane.

57. The connection block as defined in claim 53, including a plurality of lateral position locking arrangements to lock a snowplow blade in a particular position in said lateral plane.

58. The connection block as defined in claim 47, including ram connectors adapted to connect a plurality of rams to said connection block.

59. A blade mount bar adapted to connected to a snowplow blade and a connection block including a plurality of pivot arrangements adapted to pivotably connect the snowplow blade for movement in a pivot plane and a lateral connector arrangement adapted to connect to the to said connector block for movement in a lateral plane, said lateral connector arrangement includes a swivel opening that defines an axis of said lateral plane and a control opening adapted to receive a connector adapted to engage the connection block to allow movement in said lateral plane in a limited range.

60. The blade mount bar as defined in claim 59, including a lock opening adapted to receive a connector adapted to engage the connector block substantially prevent movement in said lateral plane.

* * * * *